US009440429B2

(12) United States Patent
Jenny

(10) Patent No.: US 9,440,429 B2
(45) Date of Patent: Sep. 13, 2016

(54) DRYING LIGHT SOURCE

(75) Inventor: Reinhard Jenny, Schlieren (CH)

(73) Assignee: VOLPI AG, Schlieren (CH)

( * ) Notice: Subject to any disclaimer, the term of this patent is extended or adjusted under 35 U.S.C. 154(b) by 356 days.

(21) Appl. No.: 12/796,350

(22) Filed: Jun. 8, 2010

(65) Prior Publication Data

US 2010/0309659 A1 Dec. 9, 2010

(30) Foreign Application Priority Data

Jun. 9, 2009 (CH) ..... 910/09

(51) Int. Cl.
*B41F 23/04* (2006.01)
*F21V 5/00* (2015.01)
*F26B 3/28* (2006.01)

(52) U.S. Cl.
CPC ..... *B41F 23/0443* (2013.01); *B41F 23/0409* (2013.01); *F21V 5/008* (2013.01); *F26B 3/28* (2013.01)

(58) Field of Classification Search
CPC .. B41F 23/0443; B41F 23/0409; F26B 3/28; F21V 5/008; F21V 9/00; F21Y 2101/02; F21S 19/00
USPC ..... 362/268, 294
See application file for complete search history.

(56) References Cited

U.S. PATENT DOCUMENTS

| | | | | |
|---|---|---|---|---|
| 7,654,715 | B1 * | 2/2010 | Chen et al. | 362/552 |
| 7,910,899 | B2 * | 3/2011 | Platsch | 250/504 R |
| 2005/0207160 | A1 * | 9/2005 | Babayoff et al. | 362/259 |
| 2005/0219847 | A1 * | 10/2005 | Ikeda et al. | 362/268 |
| 2006/0007683 | A1 * | 1/2006 | Clark et al. | 362/268 |
| 2009/0288340 | A1 * | 11/2009 | Hess | A01G 9/26 47/58.1 LS |

* cited by examiner

*Primary Examiner* — Bao Q Truong
(74) *Attorney, Agent, or Firm* — Nath, Goldberg & Meyer; Jerald L. Meyer; Stanley N. Protigal

(57) ABSTRACT

A drying light source (1), in which the light of a number of single light sources (3) is applied heterodyned and bundled to an object level (5) with the help of optical elements (6, 4, 7, 8).

18 Claims, 5 Drawing Sheets

DRYING LIGHT SOURCE

The present disclosure relates to a drying light source for illuminating an object with at least one first individual illumination source (3) and a second individual light source.

Such light sources are preferably used in multi-color printing machines, as they are described in DE 44 42 557 (Heidelberger). These multi-color printing machines, as they are also known from DE 102 25 198, transport and transfer wet partial frames, which are fed to a drying station subsequent to an ink transfer process. These drying stations can, depending on the consistency of the printing ink, have a hot air blower, an electron irradiator according to DE 10 2007 048 282, or a UV dryer with UV light emitting diode arrays as is known, for example, from DE 10 2007 028 403.

UV-drying printing inks or lacquers consist of substances that are capable of flowing and include, for example, monomers, oligomers and/or other photo initiators, which cross-link into a dry film subject to the effect of an energy-rich UV irradiation. Today, these substances are quickly becoming more important because these can also be used for printing onto materials that are not very absorbent. The hardening speed, i.e. the degree of hardening is, for example, dependent upon the design and power of the UV irradiators, the machine speed, the materials that are to be printed and/or the composition of the ink.

The UV hardening process—sometimes also simply called UV drying, can be used in almost all areas of the printing industry, especially there, where fast drying of the printing ink and/or lacquers is desired for fast further processing. Thus, the method is suitable not only for the accelerated printing of paper and/or carton for the production of high-gloss prospectuses or high-gloss packaging, but also for the printing of plastic material and for tin printing.

But for some applications it is advantageous to perform UV drying with different wave lengths, for example, in order to first only touch-dry a printing ink and to then thoroughly harden its entire volume or to activate different photo initiators. Suitable ink hardening devices include a drying light source, in the following also called multi-wavelength light source, as it is described, for example, in DE 10 2004 015 700. The light emitting diodes (LEDs) used in this drying light source are configured in rows and do not only have different wave lengths, but can also be switched on separately, in order to, if necessary, use individual wave lengths separately.

The LED drying light sources constructed in this way are sensitive to temperature changes and require, because of their design (closely adjacent high power LEDs), expensive cooling means. Beyond that, these drying light sources must be mounted very close to the object to be illuminated because of the large aperture emission characteristic of the high power LEDs. This leads to extremely narrow spatial relationships, which severely limits the variability for the design of the drying light source and thus the possibilities of application and use of such in different printing machines.

For this reason, it desired to provide a drying light source with which the known disadvantages of the known drying light source can be overcome. In particular, no expensive and/or interference-prone cooling means are to be required and the spatial relationships are to allow a simplified coordination with the special use of the drying light source in different printing machines.

In accordance with the disclosed technology, this objective is solved by a drying light source with the characteristics of claim 1, and in particular, by a multi-wavelengths overall light source with an optical unit for heterodyning different beam bundles. Advantageously, this multi-wavelength overall light source comprises at least one first individual light source and a second individual light source, whereby their emitted light respectively has a dominant wave length ($\lambda_1$, and/or $\lambda_2$) and optical means are provided for heterodyning the emitted light of these individual light sources.

One configuration of the drying light source differentiates itself thereby, that the optical means comprise at least one reflector and/or at least one beam divider, whereby the reflector is mounted and designed in such a way that at least the emitted light ($\lambda_1$) of the first individual light source is reflected and strikes heterodyned with the emitted light ($\lambda_2$) of the second individual light source onto the object field that is to be illuminated, and whereby the beam divider is mounted and designed in such a way that the emitted light ($\lambda_1$) of the first individual light source is reflected onto the object field that is to be illuminated and the emitted light ($\lambda_2$) of the second individual light source can pass unhindered in order to heterodyne itself with the emitted light ($\lambda_1$) of the first individual light source.

For the individual single light sources of the drying light source high power LEDs (LS1, LS2, LS3) with large aperture emission, halogen beamers or gas discharge lamps have shown to be particularly suitable. Thereby, it was shown to be advantageous when the individual single light sources (LS1, LS2, LS3) are provided with condenser optics (CO1, CO2, CO3) and/or a collector is provided between the beam dividers and the object to be illuminated.

In a further configuration of the drying light source, optic characteristics for the homogenization of the total light that is striking the object field to be illuminated are provided between the beam dividers and the object field to be illuminated.

Advantageously, the optical means for heterodyning the emitted light comprise cylindrical and/or spherical optical elements.

In one configuration, the drying light source differentiates itself thereby, that at least one of the individual single light sources comprises an illumination arrangement with an LED array of m×n LEDs. Thereby, the LED array can have a number of similar or different LEDs and/or the illumination unit can have several LED arrays.

In the following, the disclosed technology will be explained in more detail using individual examples of embodiments, and in conjunction with the figures.

BRIEF DESCRIPTION OF THE DRAWINGS

Shown are.

DETAILED DESCRIPTION

Figure 1:
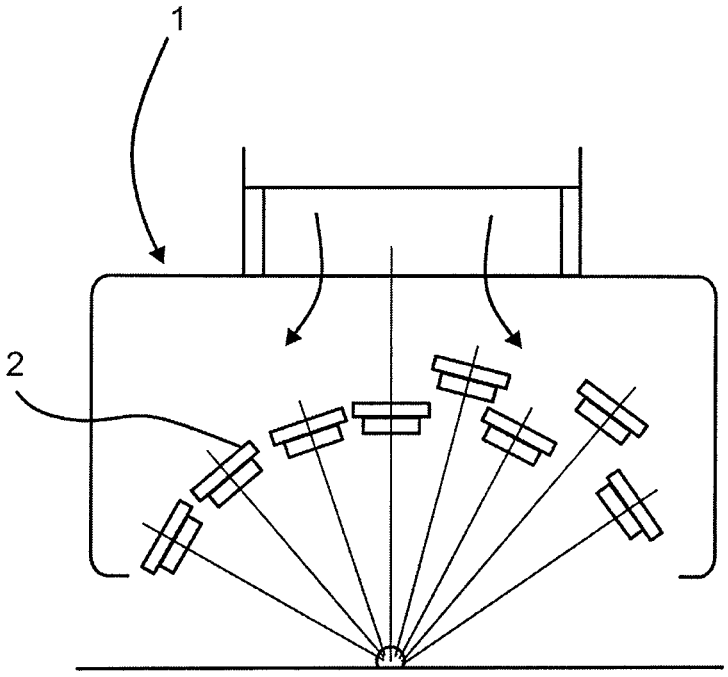
FIG. 1: a drying light source according to prior art.

The configuration shown in FIG. 1 of a UV drying light source (1) is known from published patent application DE 10 2004 015 700 A1. Thereby, the individual LEDs (2) are configured in a housing in such a way, that their beams are jointly directed to an object zone. Because of the short distances to the object zone, and the undesired build-up of heat in the proximity of this object zone, cool air is circulated around the LEDs.

Figure 2:
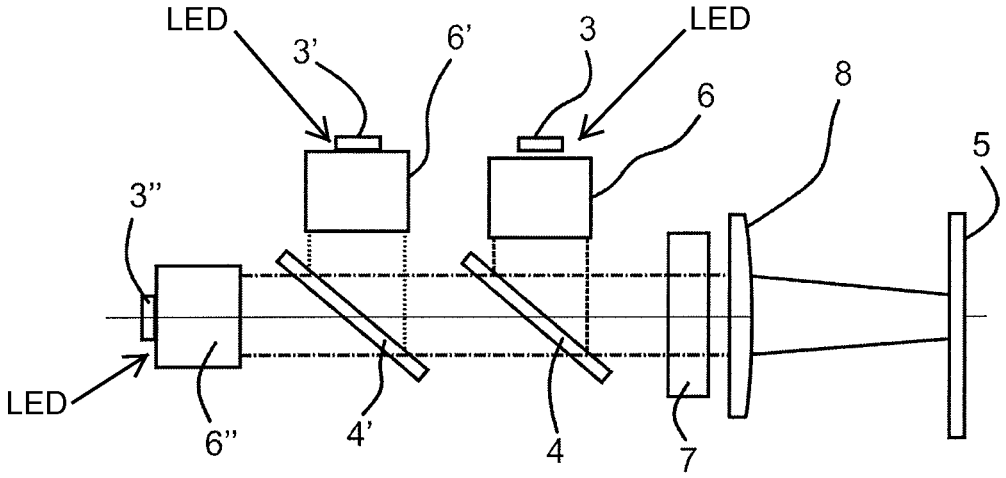
FIG. 2: an optic arrangement of a drying light source.

The configuration shown in FIG. 2 according to the disclosure comprises individual light sources (3, 3', 3") with respectively one dominant wave length $\lambda_1$, $\lambda_2$, $\lambda_3$, for example, LEDs, halogen lamps, discharge lamps for the illumination of an object field (5). For line illumination, the individual light sources are located sequentially along a line. This configuration comprises respectively pertaining condenser optics (6, 6', 6"), a first (4) and a second (4) beam divider, optics for the homogenization (7) of the converged light beam bundle and a collector (8). Thereby, the first beam divider (4) is designed strongly reflecting for light with a first wave length $\lambda_1$ and strongly permeable for light with a second wave $\lambda_2$ and light with a third wave length $\lambda_3$, while the beam divider (4') is designed strongly reflecting for light with a second wave length $\lambda_2$ and strongly permeable for light with a third wave length $\lambda_3$. The optics for homogenization (7) of the heterodyne beam bundles can be realized with a micro lens array, with a spherical lens or an aspherical lens. The collector (8) can comprise an aspherical or an amorphous lens.

The arrangement can have cylindrical optics (for linear illumination) as well as also spherical optics (for punctiform or two-dimensional light sources). The possible wave lengths are in the range of UV to IR of the electro-magnetic spectrum. The superposition of light of several wave lengths with limited spectrum is possible. Thereby, the spectra can be separate from each other or overlap only sometimes.

The single light sources typically comprise high performance LEDs with large aperture emission, but they can also comprise classic illuminants such as, for example, halogen beams or gas discharge lamps.

Figure 3:
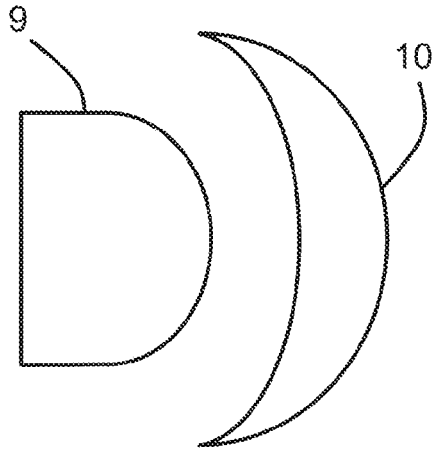
FIG. 3: condenser optics with spherical lenses.
Figure 4:
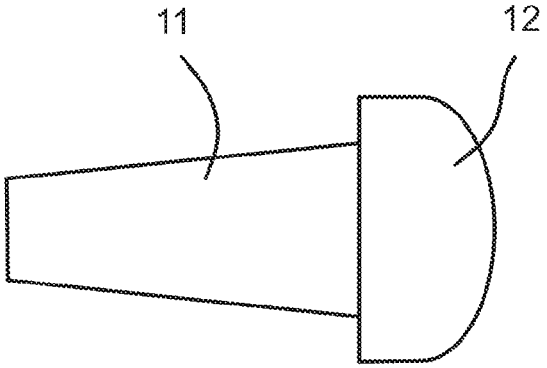
FIG. 4: condenser optics with a lens and an optical fiber element.
Figure 5:
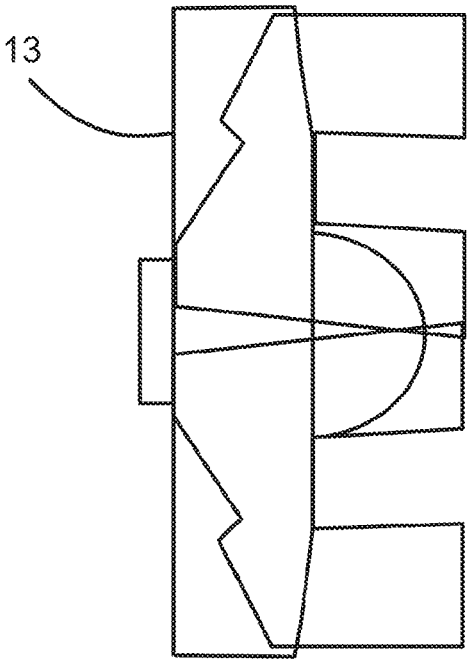
FIG. 5: condenser optics with a suitably shaped reflector.

FIGS. 3, 4 and 5 show suitable configurations for the condenser optics (6, 6', 6"). Thereby, FIG. 3 shows a configuration with spherical lenses (9, 10), FIG. 4 a configuration with a fiber-optic element (11) with lens (12) and FIG. 5 a configuration with a specially molded optical element (13). This molded optical element (13) generates several differently guided bundles of rays from the same individual light source.

Thereby, the condenser optics (6, 6', 6") can be rotation-symmetric or linearly extended. For linear systems such as linear illumination, the linear extension can be realized by a sequential arrangement of individual optical elements as shown in 3, 4 and 5. When using such condenser optics (6, 6', 6") optics for the homogenization (7) of the heterodyned light beams and a collector (8) can also be dispensed with.

In order to achieve a high level of strength of irradiation onto the object area (5), the individual light sources (3, 3', 3") can also comprise LED arrays with n×n or m×n LED elements (chips). It is self-evident that the arrangement is thus suitable for the use of smaller LED elements, as well as also for use with larger LED arrays. For linear illumination, the LED elements or LED arrays can be configured sequentially along a line.

Figure 6:
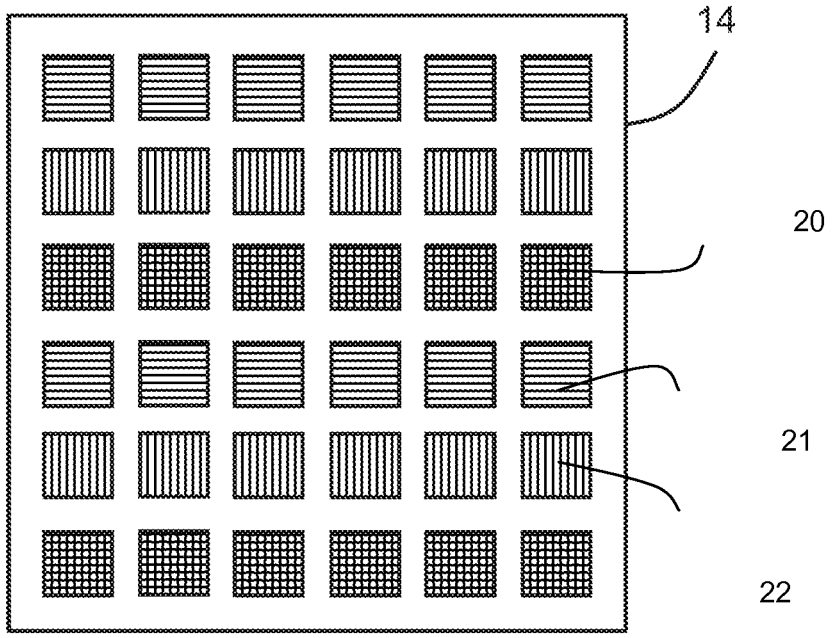
FIG. 6: an LED array with LEDs of different wave lengths.

FIG. 6 makes it clear that when using LED arrays, a uniform multi-wave lengths LED array (14) can be created, by configuring LED chips (20, 21, 22) with different wavelengths distributed in an array. Here, the red-luminous, green-luminous and blue-luminous LED chips are evenly distributed.

Figure 7:
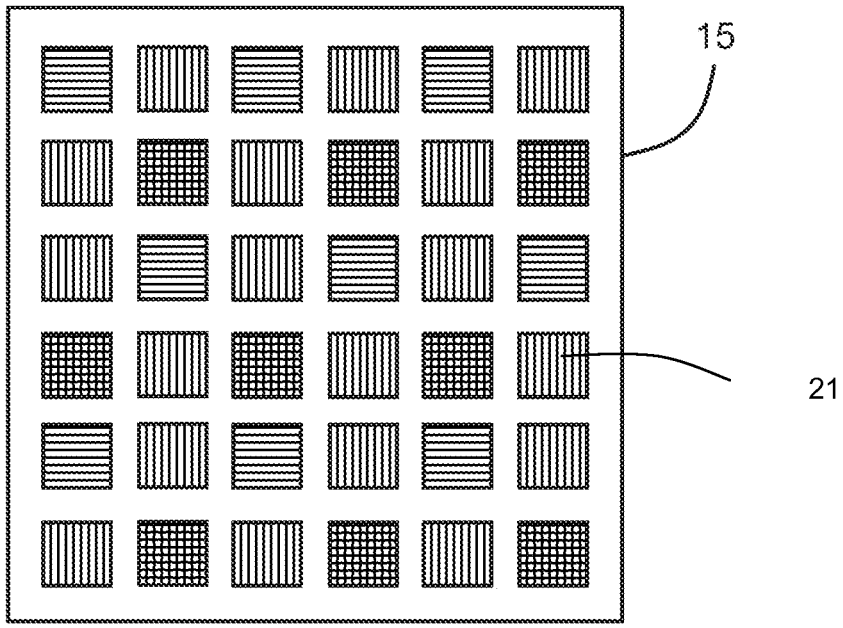
FIG. 7: an LED array with dominant wave length.
Figure 8:
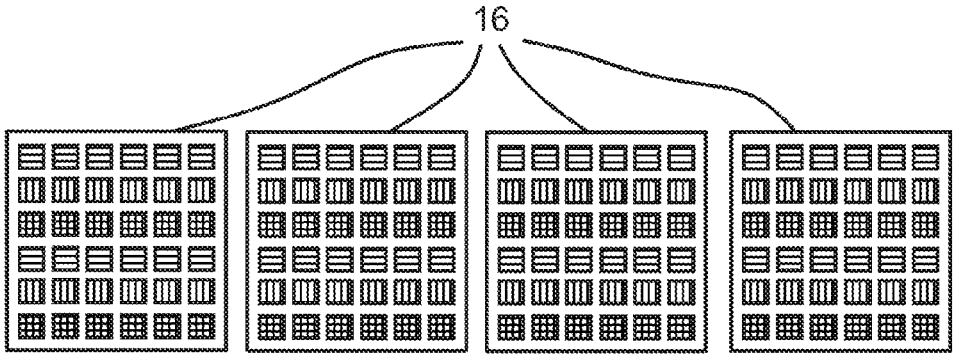
FIG. 8: a linear configuration of several LED arrays.
Figure 9:
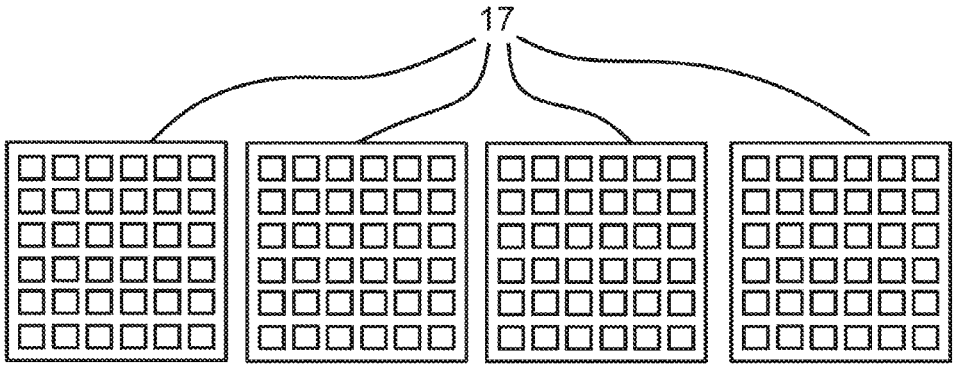
FIG. 9: a linear configuration of several LED arrays with the same spectral emission.
Figure 10:
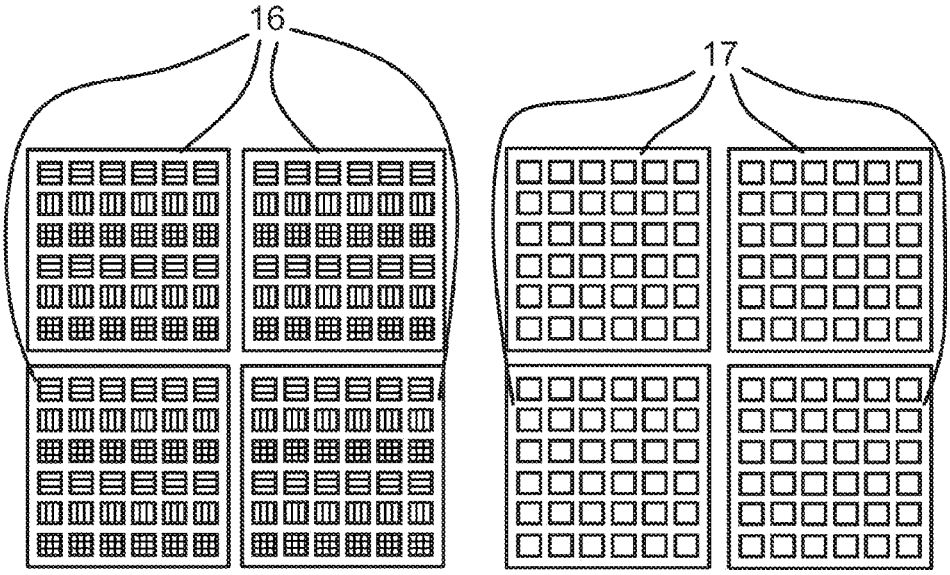
FIG. 10*a*), *b*): field-shaped configuration of several LED arrays.
Figure 11:
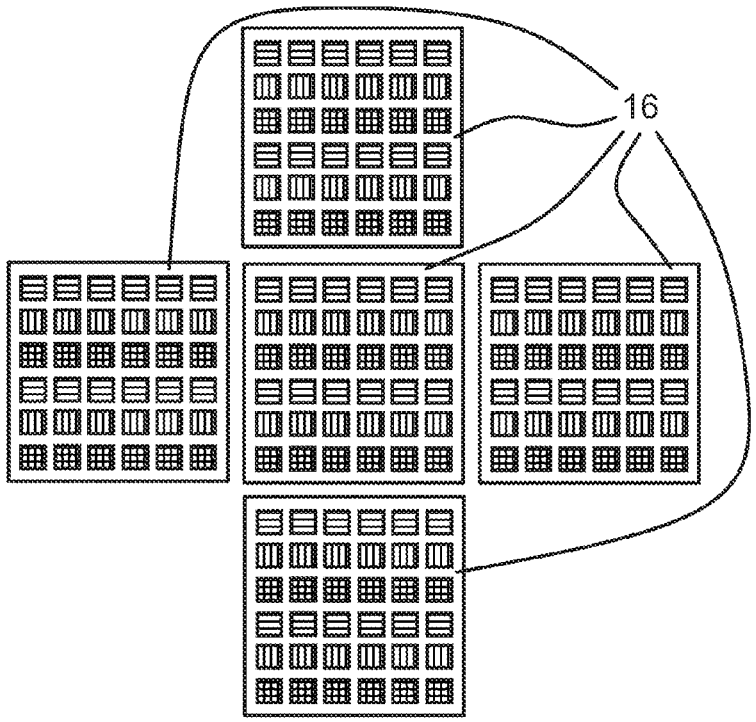
FIG. 11: a cruciform configuration of several LED arrays.
Figure 12:
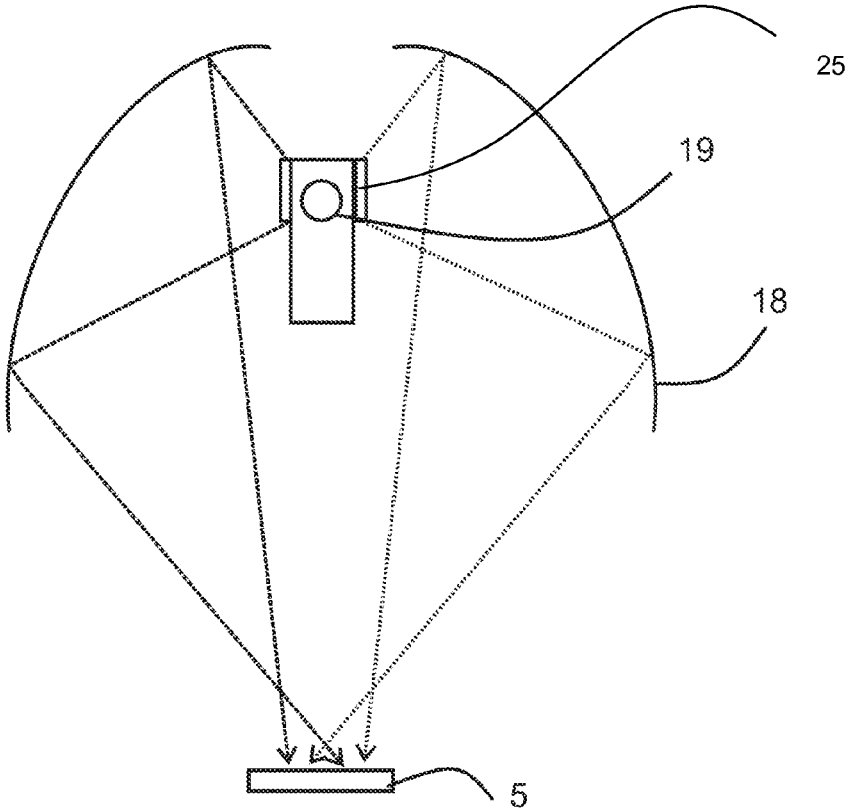
FIG. 12: a further optical configuration of a drying light source.

If a selected spectral range of the emitted light is to be dominant, the selection of the individual LED chips can be changed. For example, the dominant emission of green light can be achieved by using more green-luminescent LED chips (21) than those that have a different wave length. FIG. 7 shows such an LED array (15) with dominant spectral emission. It is self-evident that in place of red-luminescent, green-luminescent or blue-luminescent chips, different chips with other wave lengths can also be used, for example, with wave lengths in the deep blue spectrum and in the UV spectrum, for example, 365 nm, 385 nm and 395 nm. Typical values for the strength of LED high power diode arrays are:

365 nm>630 mW
405 nm>5.1 Watt
High power LED red>875 lumen
High power LED green>2,100 lumen
High power LED blue>400 lumen
High power LED white>800-1,000 lumen FIG. 8 shows a linear illumination unit (25) for linear lamps in which the individual multi-wavelengths LEDs and/or multi-wavelengths LED arrays (16) are configured sequentially along a line. It is self-evident that linear illumination arrangements (25) with single wave lengths LED arrays (17), which, as is shown in FIG. 9, have only LEDs with the same wave length spectrum, can likewise be realized. The two illumination units (25) that are shown in FIGS. 10*a*) and *b*) represent field configurations of multiple wave length LED arrays (16), and/or single wave length LED arrays. A different embodiment is shown in FIG. 11. Here, the LED arrays (16) form an illumination configuration in the form of a cruciform field.

A further optical configuration for a drying light source has a reflector (18) in the light path between the LEDs and/or LED arrays and the object field (5). This reflector (18) can have an elliptical cross section or it can be shaped in the manner desired. Alternatively, individual LED arrays are mounted on a heat dissipating carrier element with or without a cooling channel (19).

The advantages of are apparent to the person skilled in the art and are to be seen in particular therein, that with the help of optical elements and if needed, with the aid of high power LEDs, a drying light source is provided that can easily be coordinated with the respective purpose of the application and use, which is powerful, has little tendency to be interference-prone, i.e. a drying light source that does not overheat itself.

The invention claimed is:

1. Drying light source (1) for illuminating an object with plural high power LEDs, the drying light source comprising:

at least one first individual illumination source (3) comprising at least one high power LED requiring substantial heat dissipation and a second individual light source (3') comprising at least one high power LED requiring substantial heat dissipation, whereby their emitted light respectively has a dominant wave length ($\lambda_1$, and/or $\lambda_2$), and providing a converged beam light beam bundle; and a collector (8), characterized by, optic means (6, 6', 4, 4') providing heterodyning of the emitted light and providing homogenization of the converged light beam bundle, the homogenization of the converged light beam bundle realized with a micro lens array comprising a spherical lens or an aspherical lens, the high power LEDs having a spacing to allow separation of the LEDs to reduce a tendency of interference, thereby avoiding overheating.

2. Drying light source (1) for illuminating an object with plural high power LEDs, the drying light source comprising:

at least one first individual illumination source (3) comprising at least one high power LED requiring substantial heat dissipation and a second individual light source (3') comprising at least one high power LED requiring substantial heat dissipation, whereby their emitted light respectively has a dominant wave length ($\lambda_1$, and/or $\lambda_2$), and providing a converged beam light beam bundle;

a collector (8);

optic means (6, 6', 4, 4') providing heterodyning of the emitted light and providing homogenization of the converged light beam bundle realized with a micro lens array; and the high power LEDs having a spacing to allow separation of the LEDs to reduce a tendency of interference, thereby avoiding overheating, wherein the optic means comprise at least one beam divider (4), whereby the beam divider is mounted and designed in such a way that the emitted light ($\lambda_1$) of the first light source (3) is reflected onto the object field (5) that is to be illuminated and the emitted light ($\lambda_2$) of the second individual light source (3') can pass unhindered in order to heterodyne itself with the emitted light ($\lambda_1$) of the first light source (3).

3. Drying light source (1) according to claim 2, characterized by, that the individual illumination sources (LS1, LS2, LS3) are LEDs that have large aperture emission, halogen radiators or gas discharge lamps.

4. Drying light source (1) according to claim 3, characterized by, that the individual illumination sources (LS1, LS2, LS3) are provided with an optical condenser (CO1, CO2, CO3).

5. Drying light source (1) according to claim 3, characterized by, that a collector (8) is provided between the beam dividers (4, 4') and the object field (5) that is to be illuminated.

6. Drying light source (1) according to claim 3, characterized by, that between the beam dividers (4, 4') and the object field (5) that is to be illuminated, an optical means (7) is provided for the homogenization of the heterodyned irradiation.

7. Drying light source (1) according to claim 1, characterized by, that the optical means comprise cylindrical and/or spherical optical elements.

8. Drying light source (1) according to claim 1, characterized by, that at least one of the light sources (3, 3', 3") comprises an illumination arrangement (25) with an LED array (14, 15, 16, 17) of n×n or m×n LEDs.

9. Drying light source (1) according to claim 8, characterized by, that the LED array (14, 15, 16, 17) has a number of similar or different LEDs (20, 21, 22).

10. Drying light source (1) according to claim 8, characterized by, that the illumination unit (25) has several LED arrays (14, 15, 16, 17).

11. Drying light source (1) according to claim 4, characterized by, that a collector (8) is provided between the beam dividers (4, 4') and the object field (5) that is to be illuminated.

12. Drying light source (1) according to claim 4, characterized by, that between the beam dividers (4, 4') and the object field (5) that is to be illuminated, an optical means (7) is provided for the homogenization of the heterodyned irradiation.

13. Drying light source (1) according to claim 5, characterized by, that between the beam dividers (4, 4') and the object field (5) that is to be illuminated, an optical means (7) is provided for the homogenization of the heterodyned irradiation.

14. Drying light source (1) according to claim 1, characterized by, that the optic means comprise at least one reflector (18), whereby the reflector (18) is mounted and designed in such a way that at least the emitted light ($\lambda_1$) of the first individual light source (3) is reflected and strikes heterodyned with the emitted light ($\lambda_2$) of the second individual light source (3') onto the object field (5) that is to be illuminated.

15. Drying light source (1) according to claim 14, characterized by, that the individual illumination sources (LS1, LS2, LS3) are LEDs that have large aperture emission, halogen radiators or gas discharge lamps.

16. Drying light source (1) according to claim 15, characterized by, that the individual illumination sources (LS1, LS2, LS3) are provided with an optical condenser (CO1, CO2, CO3).

17. Drying light source (1) according to claim 15, characterized by, that a collector (8) is provided between the beam splitters (4, 4') and the object field (5) that is to be illuminated.

18. Drying light source (1) according to claim 15, characterized by, that between the beam dividers (4, 4') and the object field (5) that is to be illuminated, an optical means (7) is provided for the homogenization of the heterodyned irradiation.

* * * * *